US006899547B1

(12) United States Patent
Chang et al.

(10) Patent No.: US 6,899,547 B1
(45) Date of Patent: May 31, 2005

(54) MULTI-CHIP CONNECTOR MODULE HAVING ONE OR MORE SEMICONDUCTOR DICE

(76) Inventors: Stanley M. Chang, 5612 Stevens Creek Blvd., #123, Cupertino, CA (US) 95014; Kirby H. Spalding, 2655 Aragon Way, San Jose, CA (US) 95125

( * ) Notice: Subject to any disclaimer, the term of this patent is extended or adjusted under 35 U.S.C. 154(b) by 0 days.

(21) Appl. No.: 10/658,431

(22) Filed: Sep. 8, 2003

Related U.S. Application Data

(63) Continuation-in-part of application No. 10/309,675, filed on Dec. 4, 2002, now abandoned.

(51) Int. Cl.[7] ..... H01R 12/00
(52) U.S. Cl. ..... 439/65; 439/74
(58) Field of Search ..... 439/65, 701, 541.5, 439/76.1, 74

(56) References Cited

U.S. PATENT DOCUMENTS

| | | | | | |
|---|---|---|---|---|---|
| 4,390,220 | A | * | 6/1983 | Benasutti | 439/71 |
| 4,603,320 | A | | 7/1986 | Farago | |
| 4,686,506 | A | | 8/1987 | Farago | |
| 4,972,470 | A | * | 11/1990 | Farago | 713/192 |
| 5,007,841 | A | * | 4/1991 | Smolley | 439/66 |
| 5,046,955 | A | | 9/1991 | Olsson | |
| 5,118,300 | A | | 6/1992 | Zarreii | |
| 5,299,942 | A | | 4/1994 | Burke | |
| 5,312,261 | A | | 5/1994 | Burke | |
| 5,668,698 | A | | 9/1997 | Jozwiak | |
| 5,924,899 | A | * | 7/1999 | Paagman | 439/701 |
| 6,027,376 | A | | 2/2000 | Matsuura | |
| 6,064,254 | A | | 5/2000 | Vogley | |
| 6,081,430 | A | * | 6/2000 | La Rue | 361/788 |
| 6,091,147 | A | | 7/2000 | Furuyama | |
| 6,398,588 | B1 | * | 6/2002 | Bickford | 439/608 |
| 6,721,195 | B2 | * | 4/2004 | Brunelle et al. | 365/63 |
| 6,764,343 | B2 | * | 7/2004 | Ferentz | 439/620 |

* cited by examiner

*Primary Examiner*—Chandrika Prasad

(57) ABSTRACT

An integrated electrical connector with one or more semiconductor dice coupled to a plurality of signal blades provided in accordance with the principles of this invention. Incoming signals are processed by one or more semiconductor dice for applications such as reducing transmission line effect attributable to noise, cross-talk, signal attenuation, and other signal degradation effects before being re-transmitted as reconditioned outgoing signals as a set of corresponding output signals from the integrated connector via a plurality of signal and shield blades. Providing one or more semiconductor dice in the connector allows degradation from high-speeds transmission line paths along a printed circuit be segmented and corrected at the site of these integrated electrical connectors before being retransmitted to the next circuit board or device along the signal path.

11 Claims, 9 Drawing Sheets

IC mounted on Pin subassembly

MULTI-CHIP CONNECTOR MODULE HAVING ONE OR MORE SEMICONDUCTOR DICE

CROSS-REFERENCED APPLICATION

This application is a continuation-in-part application to previously filed Dec. 4, 2002, U.S. Non-Provisional Patent Application No. 10/309,675, now abandoned.

FIELD OF THE INVENTION

The invention relates to electrical connectors, particularly to electrical connectors for coupling high-speed printed circuit boards.

BACKGROUND OF THE INVENTION

Existing electrical connectors are assemblies of pins, latching elements, support elements, electrical conduction elements, and housing. These connectors are typically used to provide electrical signal conductivity from one printed circuit board to another. FIG. 1 illustrates a typical prior art electrical backplane connection scheme for coupling electrical signals between high speed backplanes and daughter cards via conventional electrical connectors 26 shown in FIG. 2. Backplanes are one form of printed circuit board. High speed backplane 50 is typically coupled via one or more electrical connectors 26 to remote semiconductor devices on one or more printed circuit boards, such as daughter cards 10 or line cards 30. Electrical connector 26, consisting of a mother board or backplane side connector 20 with a corresponding mating connector 16 on the daughter board. Connectors 20 and 16 typically consist of passive, non-active components that conducts electrical signals, such as originating from one daughter card 10 via electrical connector 16, which is mated to backplane 50 via electrical connector 20, the conducted electrical signals is then again transmitted down one or more electrical conductive paths 52 on mother board or backplane 50 to another destination printed circuit board 30, again via similar electrical connectors 20 and 16. The backplane conduction path 52 is depicted as a point to point connection. However, any backplane topology may also be applied to this invention such as multipoint, mesh, and star topology.

Prior art scheme with conventional connectors 16 and 20 require semiconductor device 12 on daughter card 10 to transmit electrical signal across the entire transmission path 54 ending at the receiving semiconductor device 32 on daughter card 30. This requires driver 13 (FIG. 2) in semiconductor device 12 on daughter card 10 to handle reflections caused by discontinuities (vias, etc.) in the signal path, cross talk caused by the first set of electrical connector 26, and signal attenuation due to the entire PCB transmission paths 14, 52, and 34. Driver 13 compensates for any of adverse transmission effects along this path typically results in compounded effects, such as increasing amplitude to compensate for signal attenuation may also increase cross talk. Receiver 33 on daughter card device 32 must also correctly interpret the electrical signals after traversing the entire transmission path 54.

Electrical connectors 16 and 20 receive electrical signals, and serve as an electrical conduction means for the electrical signals they conduct. Connectors 16 and 20 are constructed and designed to provide maximum conduction with minimum perturbation to the electrical signals conducted. Semiconductor devices 12 and 32 on daughter cards 10 and 30, respectively, in effect drive the electrical signals with some degrading effects from the electrical connectors 16 and 20. However, as electrical signal frequency increases into and beyond Gigabits and Giga Hertz domain as in increasingly high speed applications, the adverse effects of the electrical connectors 16 and 20 to transmission path 54 become critical. Some of the resulting adverse effects of electrical connectors 16 and 20 are cross talk, signal attenuation, and reflection, which no longer are trivial effects at these higher frequencies. The electrical signals at high speeds, e.g. 1 Gbps to 10 Gbps and beyond have more stringent AC requirements. The additional complexity from the increased stringent requirements along with the increasing adverse effects from the electrical connectors limits achievable data rates across the backplane and subsequently the entire system.

There is therefore a need to provide an improved electrical connector for high-speed electrical backplane applications that minimizes the adverse effects of cross talk, signal attenuation and reflection while leverage more cost effective materials, e.g. FR4, to achieve the higher data rates.

SUMMARY OF THE INVENTION

An integrated multi-chip connector module comprising an array of substrate assemblies having one or more semiconductor dice, each substrate assembly also comprising a plurality of connector pins appropriately coupled to the one or more semiconductor dice, the array of substrate assemblies encased in a connector housing. Incoming signals are processed by the one or more semiconductor dice for applications such as reducing or mitigating transmission line effect attributable to noise, cross-talk, signal attenuation, and other signal degradation effects before being re-transmitted as reconditioned outgoing signals as a set of corresponding output signals from the integrated connector. Providing one or more semiconductor dice in the connector allows degradation from high-speed transmission line paths along a printed circuit be segmented and corrected at the site of these integrated electrical connectors before being retransmitted to the next circuit board or device along the signal path.

DETAILED DESCRIPTION

Figure 1:
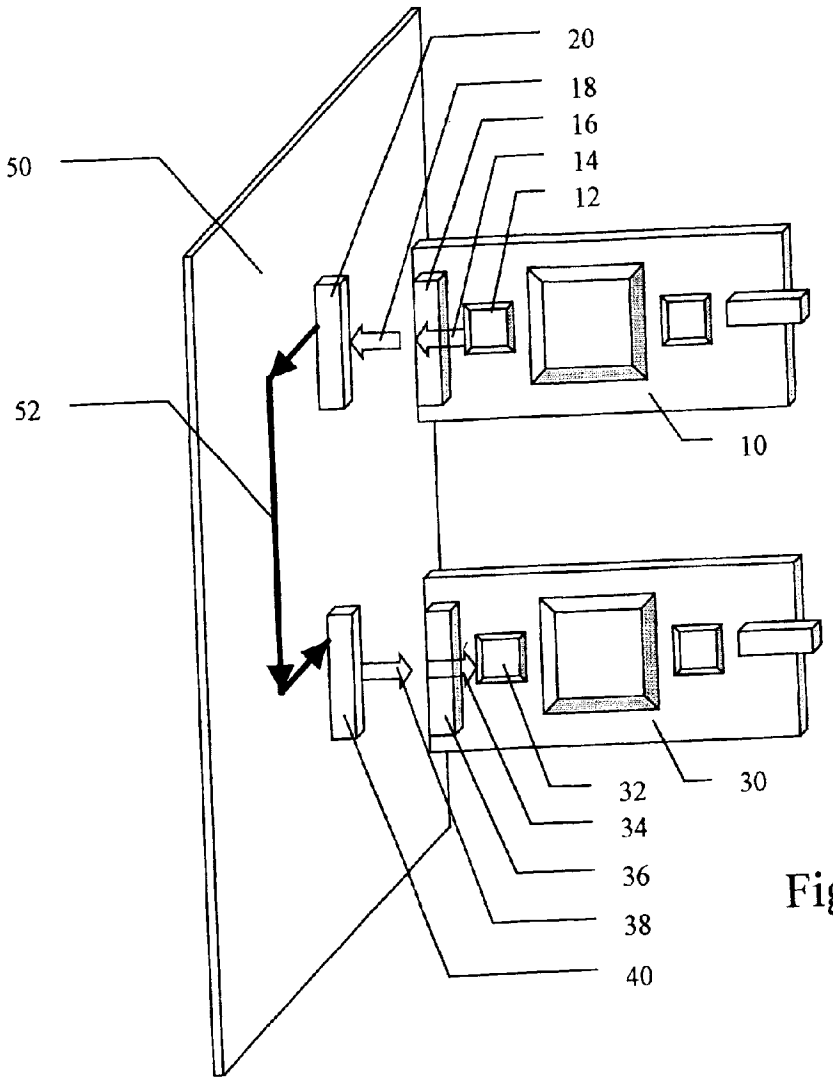
Figure 1 Prior Art
FIG. 1 illustrates a general diagram of a prior art high-speed backplane to line card or daughter card electrical conduction scheme with conventional electrical connectors.
Figure 2:
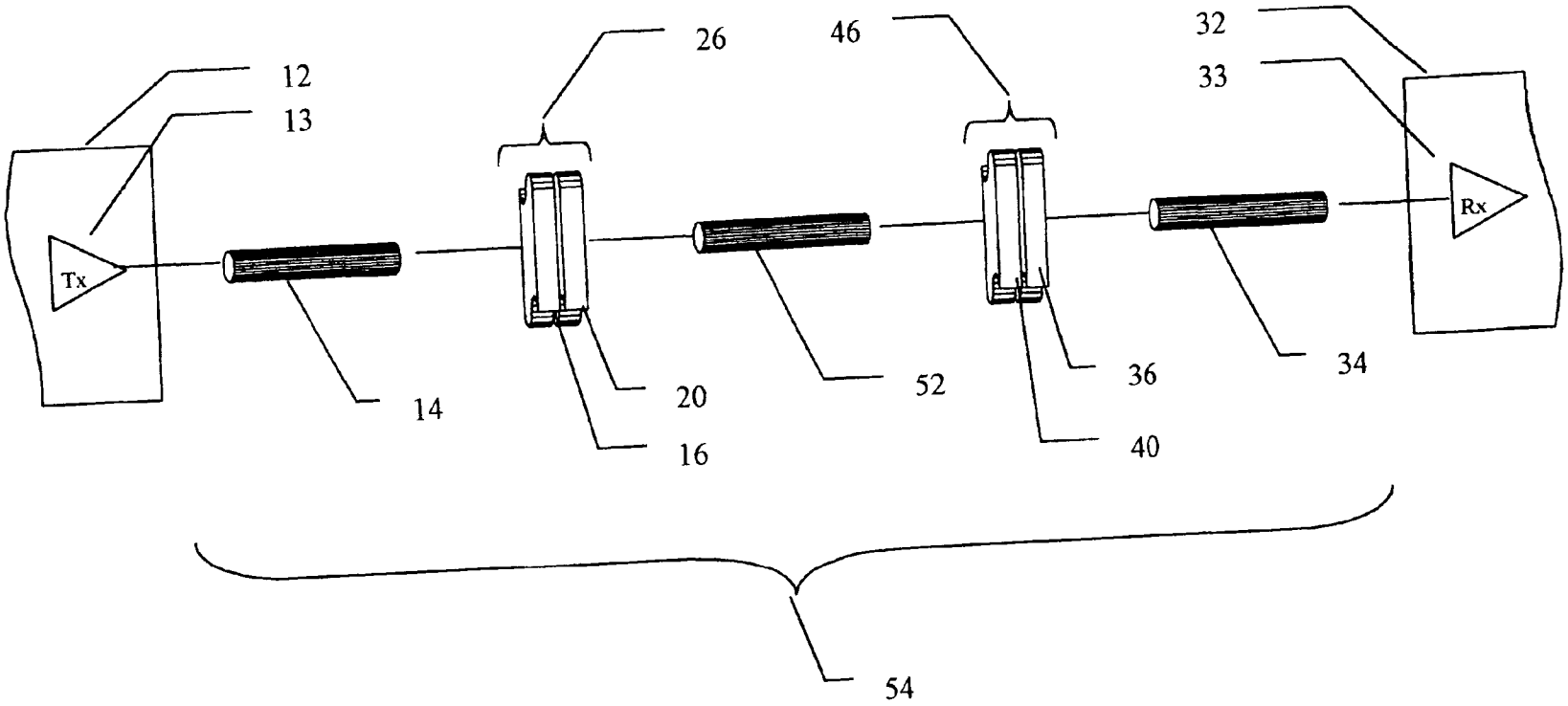
Figure 2 Prior Art
FIG. 2 illustrates a typical prior art high-speed electrical signal transmission path via conventional electrical connectors illustrated in FIG. 1.
Figure 3:
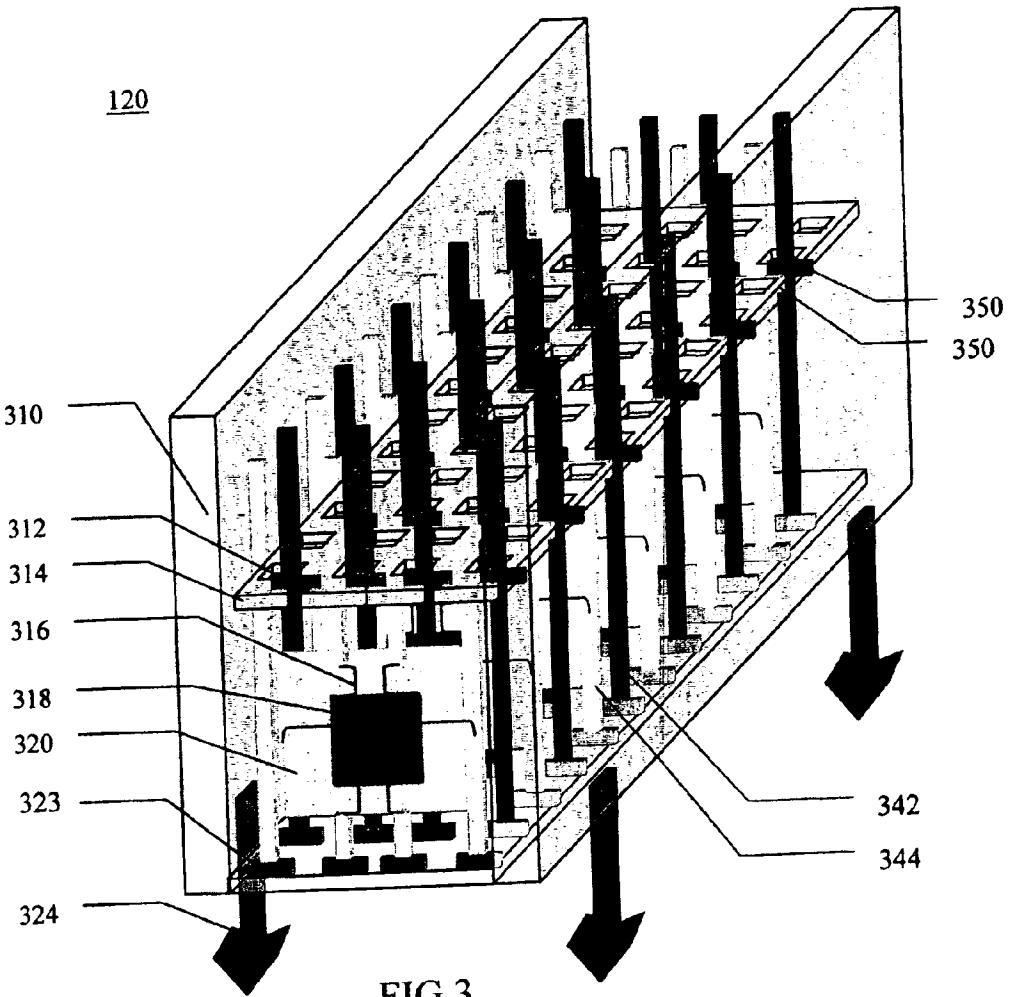
FIG. 3 illustrates an electrical connector with one or more integrated semiconductor dice provided in accordance with the principles of this invention.

FIG. 3 illustrates an electrical connector 120 with one or more integrated semiconductor dice 318 coupled to a plurality of signal blades 344 provided in accordance with the principles of this invention. Incoming signals received via one or more of the plurality of signal blades 344 are processed by one or more semiconductor dice 318 before being re-transmitted as reconditioned outgoing signals via one or more of the plurality of signal blades 344. Preferably, integrated electrical connector 120 comprises a connector shroud 310 encasing one or more semiconductor die carriers 320.

Shroud 310 of connector 120 houses the signal and shield blades 344 and 342. The blade rows may alternate between signal transmission 344 and shield or ground rows 342. Alternative signal blade and shield blade configuration are possible, e.g. such as in signal path direction, the number of blades provided, the number of power and grounds, etc. The signal and shield blade rows placed into the shroud may be aligned using an alignment template. Shroud 310 preferably encapsulates firmly signal and shield blades 342 and 344. A blade orthogonal element 350 may be provided to lock in blades 344 and 342, a plurality of semiconductor dice 318 and corresponding die carrier 320 to shroud 310. Electrical connector 120 thus also serves as packaging integrated semiconductor die 318. Thermal dissipation from the semiconductor die flows through semiconductor carrier, signal blades, as well as the connector housing 310.

In the preferred embodiment ;shown in FIG. 3, each connector 120 further comprises connector fasteners 324 to attach connector housing 310 to backplane 150. The fasteners lock the electrical connector to the backplane. Once locked in place, gold pads 323 connected to the end of these blades 322 on the connector floor create electrical connection to the gold pads on the backplane. Fasteners 324 during installation of the electrical connector 120 onto the backplane 150 creates sufficient force with its locking mechanism to ensure robust contacts between a corresponding set of gold pads on the backplane (not shown) to the gold pads 323 on connector housing 310. These fasteners allow electrical and mechanical connection of the connector housing 310 without soldering into the backplane 150, thus enabling the easy removal of the electrical connectors for upgrades or field replacement.

One or more of the semiconductor dice 318 breaks up the transmission line 154 to more manageable segments. Semiconductor die 318 receives electrical signals and processes the signal such as for differential signal interpretation, such as recovering clock signals and data signals to provide timing information throughout the semiconductor device 318 and to transmit drivers 124 (FIG. 6) in semiconductor die 318. The semiconductor die then processes the received signals for appropriate application. The recovered clock is used appropriately to provide timing information as the signals are processed. The transmit driver 124 then uses the recovered data and recovered clock to transmit the electrical signal external from semiconductor die 318. Reference clock for semiconductor die 318 may be supplied externally or created internally through clock generation means, such as via LC oscillator, VCO, phase detectors, and frequency detector.

Other embodiments of the semiconductor die 318 are possible. One example may be the receiver and the transmit driver may be binary differential signaling or multilevel differential signaling or a combination. Semiconductor die 318 would process received electrical signaling if translating between binary and multilevel differential signaling or even just for multilevel differential signaling, depending on integrated connector application. Another example may require voltage level change. More intelligence may be incorporated into the semiconductor die 318 for protocol understanding and recognition, adaptive algorithms to compensate for changes in the transmission environment, and more. These are only some examples of possible processing to illustrate possible applications and functions provided by semiconductor die 318.

Semiconductor 318 also provide full voltage levels as provided by incoming power source signal 332 (FIG. 4) and ground source 338 (FIG. 4) to semiconductor device 318. This eliminates the signal attenuation. The transmit driver 124 may also possess other functions to improve electrical signal transmission as pre-emphasis, de-emphasis, amplitude control, impedance matching, and more. This will aid in reducing other effects after transmission such as reflection and cross talk.

Figure 4:
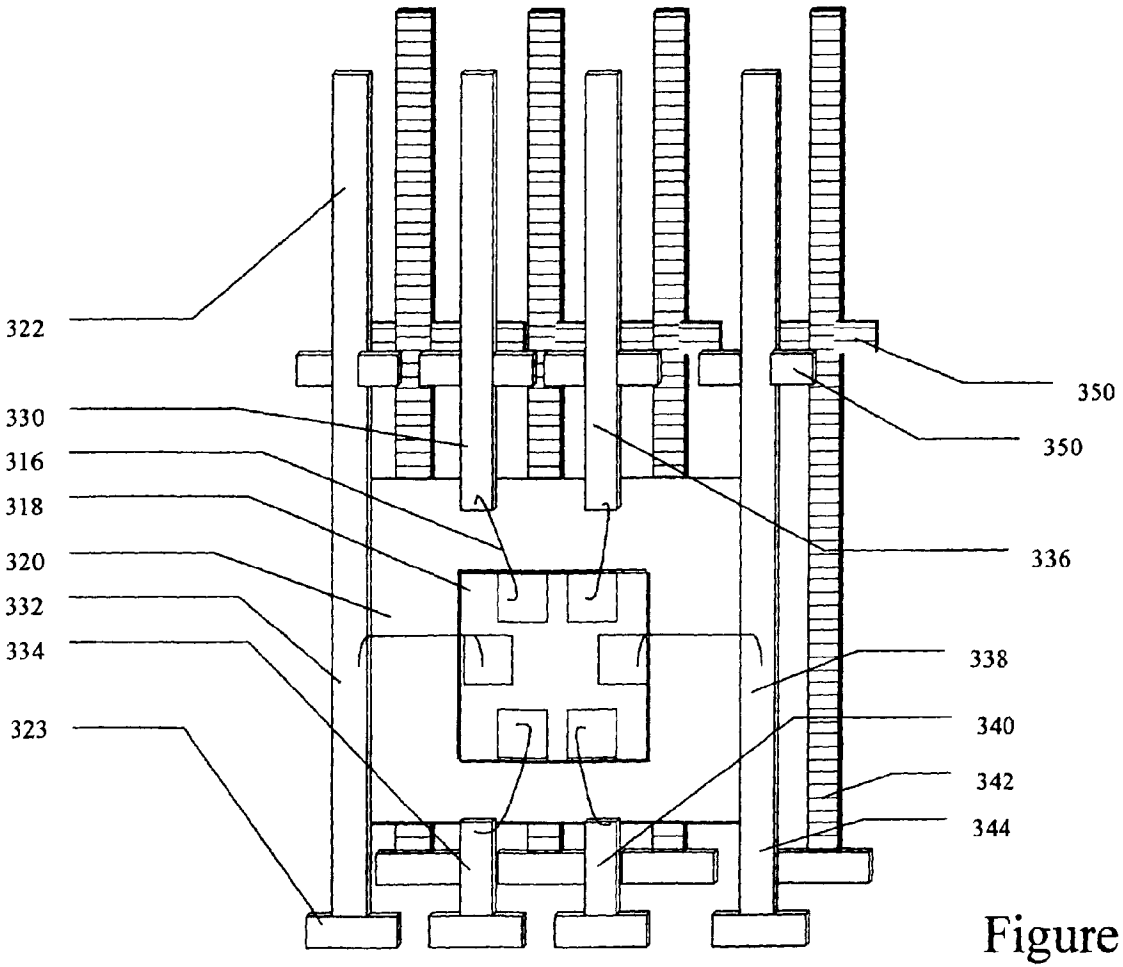
FIG. 4 illustrates a cross-sectional perspective of the electrical connector of FIG. 3 provided in accordance with the principles of this invention.

FIG. 4 illustrates a more detailed cross-section view of integrated connector 120 of FIG. 3. Each die carrier 320 preferably comprises at least one semiconductor die 318 coupled to one or more electrical signal blades 344. As shown in FIG. 4, each row of signal blades 344 preferably alternates with a row of shield or ground blades 342. In one embodiment, each signal blade 344 and shield blade 342 may be terminated at one end as a signal gold pad 323 depending on application.

In one embodiment, die carrier 320 comprises a lead frame, which may comprise a ceramic substrate or a stamped metal sheet, the lead frame being electrically attached to the semiconductor die 318. The die may be electrically attached to the lead frame a number of different ways, such as via flip chip or wire bond. The lead frame may also comprise a plurality of contact pads for external electrical connectivity. A wire bond method may be used to provide electrical connectivity from semiconductor die 318 via the lead frame to a plurality of electrical conduction paths, e.g. electrical connector blades.

Alternatively, if a stamped metal sheet is used as lead frame, the stamped metal may include the electrical connector blades or pins of electrical connector 120. Die 318 may be wire bonded to the lead frame. This allows the construction of the electrical connector blades to be constructed as a single unit to the semiconductor lead frame. Each blade used for mating with the daughter card connector would need an additional orthogonal element 350 above the semiconductor device without contact to adjacent blades. These orthogonal elements 350 spread the forces on integrated connector 120 when a daughter card is installed or removed. Preferably, gold plating the mating 322 end of signal blades 342 and 344 improves the electrical connectivity to the mating daughter card mechanical connection. Gold pads 323 on the floor end of the integrated connector 120 create electrical contact to the backplane gold pads (not shown).

Figure 5:
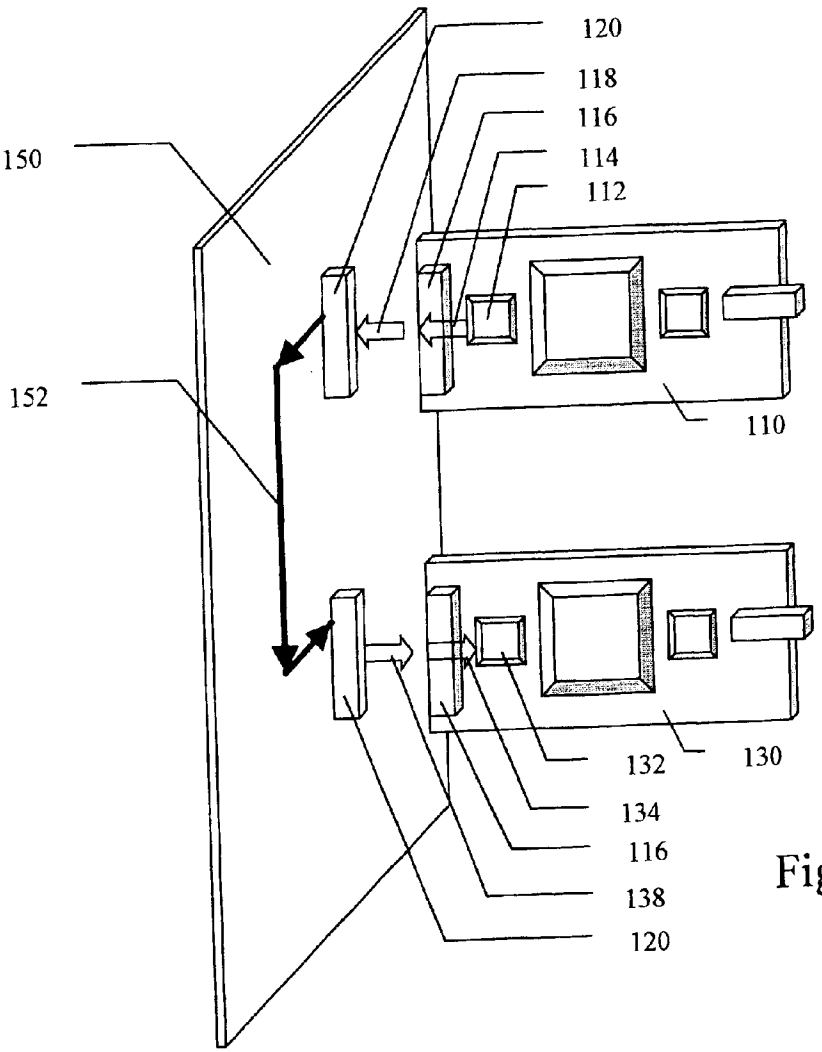
FIG. 5 illustrates a high-speed backplane to line card and daughter card application via one or more electrical connector with integrated semiconductor dice of FIG. 3 as provided in accordance with the principles of this invention.

FIG. 5 illustrates one application of integrated electrical connectors 120 in a high-speed backplane to line card 130 and daughter card 110 applications. As used herein, daughter card refers to any printed circuit board, such as line card 130 or any other application specific printed circuit board, coupled to a larger printed circuit board such as a motherboard or backplane. Connectors 120 are preferably coupled to a printed circuit board 150, such as a motherboard where electrical conduction is made to a second printed circuit board such as a daughter card or a line card 110,130. Exemplified in this application, electrical signal conduction from a semiconductor 112 on daughter card 110 traverses via signal path 114 to signal path in the daughter card portion 116 of the electrical connector 126 through a mated integrated connector 120 which is on the backplane portion of the electrical connector 126 on motherboard 150, along signal path 152 on the motherboard, through another integrated connector 120 also on backplane 150, through a mated second daughter portion 116 of the electrical connector 126 attached to line card 130, and finally along signal path 134 to target semiconductor device 132 on line card 130.

In yet another embodiment, it is contemplated as within the scope of the principles of this invention wherein connector 120 alone may be used to directly couple backplane 150 to line card 130, or other external application printed circuit board.

Figure 6:
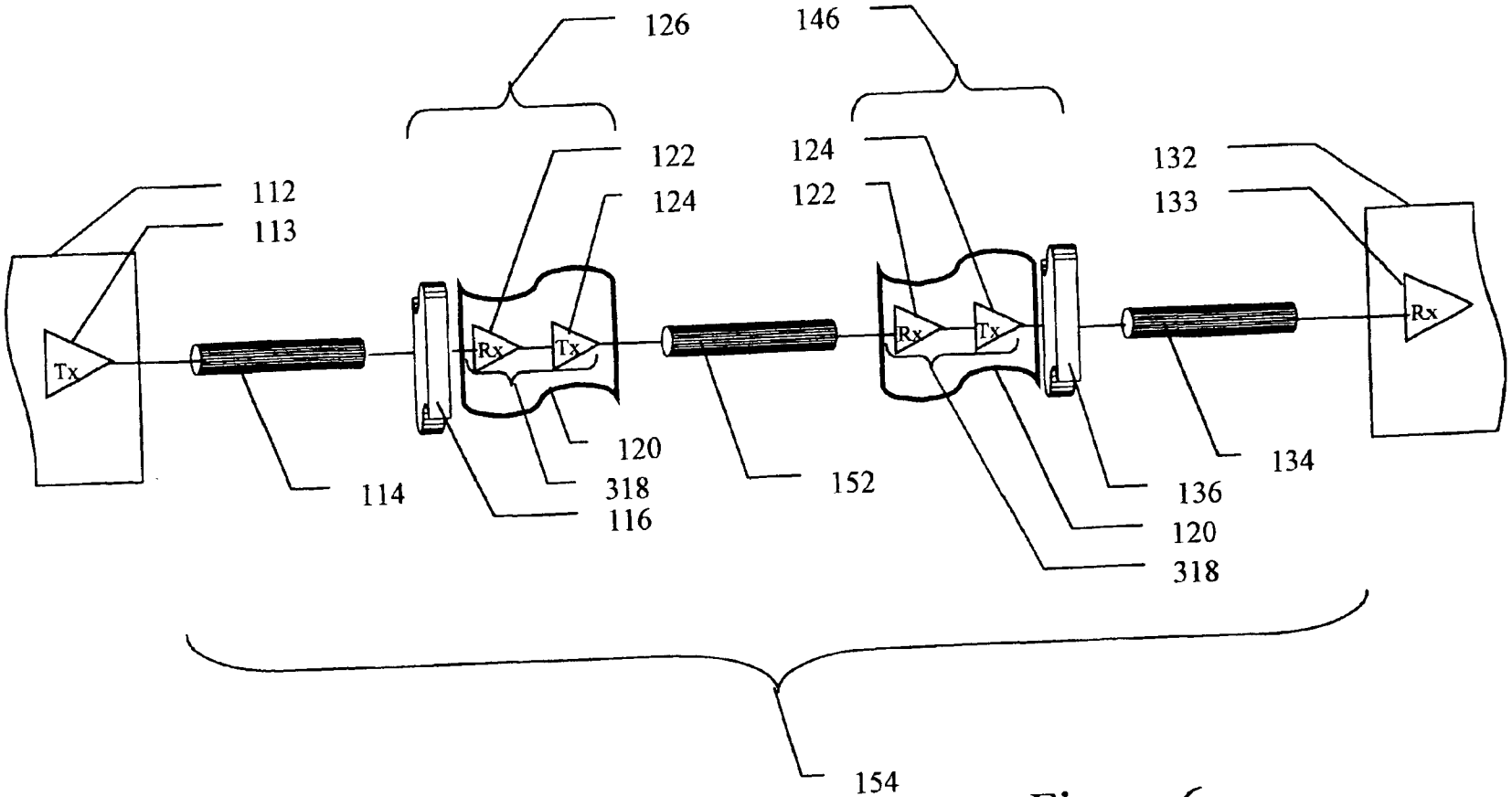
FIG. 6 illustrates a corresponding high-speed electrical signal transmission path associated with the high-speed backplane application of FIG. 5.

FIG. 6 illustrates a corresponding high-speed electrical signal transmission path 154 associated with the high-speed backplane application of FIG. 5. Electrical signals from semiconductor device 112 travel along transmission path 114 on daughter card 110, through daughter card connector 116 to integrated connector 120 on motherboard 150, along transmission line path 152 on the motherboard to second integrated connector 120, through a second mating connector 136 attached to line card 130, along transmission path 134 to target semiconductor device 132 on line card 130. In this application, each semiconductor die 318 (FIG. 3) within each integrated connector 120 preferably comprises a receiver 122 to receive incoming electrical signals and transmitter/driver 124 to re-transmit incoming signals after signal processing. In the preferred embodiment, semiconductor die 318 processes and reconditions received incoming signals to minimize or mitigate transmission line signal degradation, such as cross-talk, signal attenuation, and other signal integrity effects. Processed incoming signals are then provided as output of semiconductor die 318 and provided as re-conditioned output signals of connector 120 via transmitter/driver 124.

Integrated semiconductor die 318 minimizes the adverse effects of noise, cross talk and other adverse signal integrity effect due to transmission line effect on signal paths of high-speed signals traversing across and between printed circuit boards, or between circuit boards and cables. Alternatively, semiconductor dice may comprise other application specific functionalities as desired. Printed circuit boards 110 and 130 each comprises a mating electrical connector 116, designed to mate with the integrated electrical connector 120. Optionally, it is also contemplated that mating connector 116 also comprises an integrated connector 120 with one or more semiconductor dice. Alternatively, the daughter card connector may comprise an integrated connector 120 serving as the only integrated connector with one or more semiconductor dice. This embodiment may eliminate the need for a backplane portion of the electrical connector. This may be accomplished if the integrated daughter card connector has gold pads that connect to gold pads on the backplane.

In alternative embodiments envisioned of connector 120, the signal path direction of the receiver and transmitter may also be reversed per desired data flow direction. Alternatively, the semiconductor may possess a combination of single-ended and differential signals per desired application. These electrical signals may be used in any fashion, e.g. data, control, status, etc. Another alternative embodiment may include communication between multiple semiconductor dice in the electrical connector. Yet another alternative embodiment may have one or more semiconductor die have a combination of electrical signal input and outputs from the electrical connector as well as communication within the electrical connector. Blades are used in describing electrical and thermal access of the plurality of semiconductor dice external to the shroud housing. The face that will be mated to the daughter card portion of the electrical connector may be constructed as a blade, receptacle connectors, pads, pins, or any number of well-known structures to one skilled in the art. The electrical connection mechanism must be such that it will mate to a corresponding daughter card portion of the electrical connector. The plurality of semiconductor dice may be same or different designs depending on application needs. The shield blades may serve to conduct electrical signals. The number of blades per row may vary per application needs.

Electrical connector 120 with one or more integrated semiconductor device 318 therefore provides signal processing operations, such as reducing the transmission line effects of cross-talk, signal attenuation, and reflection, at each connector 120 site prior to retransmission of received electrical signal along signal transmission path 154. Consequently, adverse transmission line effect detrimental to high-speed signal application can be significantly minimized and mitigated via integrated connectors 120. Design requirements for semiconductor devices, such as integrated circuits 112 and 132 on the daughter cards 110 and 130, respectively, can thereby be relaxed in defining electrical signals requirements from semiconductor devices 112 and 132 along transmission paths 114 and 134 to the daughter card portion 116 and 136 using electrical connectors 120. Semiconductor die 318 integration into connector 120 further enables system benefits with better signal integrity and reducing overall bit error rate. Another benefit is the ability to transfer more data, faster, and/or farther. Data rate design targets can be achieved with cost savings and better manufacturing yields.

Providing integrated connectors 120 to recondition electrical signals from transmission line effects in connectors prior to retransmission of signals allows semiconductor device 112 and 132 on printed circuit boards 110 and 130 be designed with less electrical drive, lower power, higher speeds, and less transmission line compensation complexity. Signal reflection, cross talk, and signal attenuation due to electrical connectors are also thereby greatly reduced and mitigated by integrating one or more semiconductor 318 into electrical connector 120. In yet another embodiment, integrated connectors 120 may be coupled in applications to electrical cables.

Figure 7:
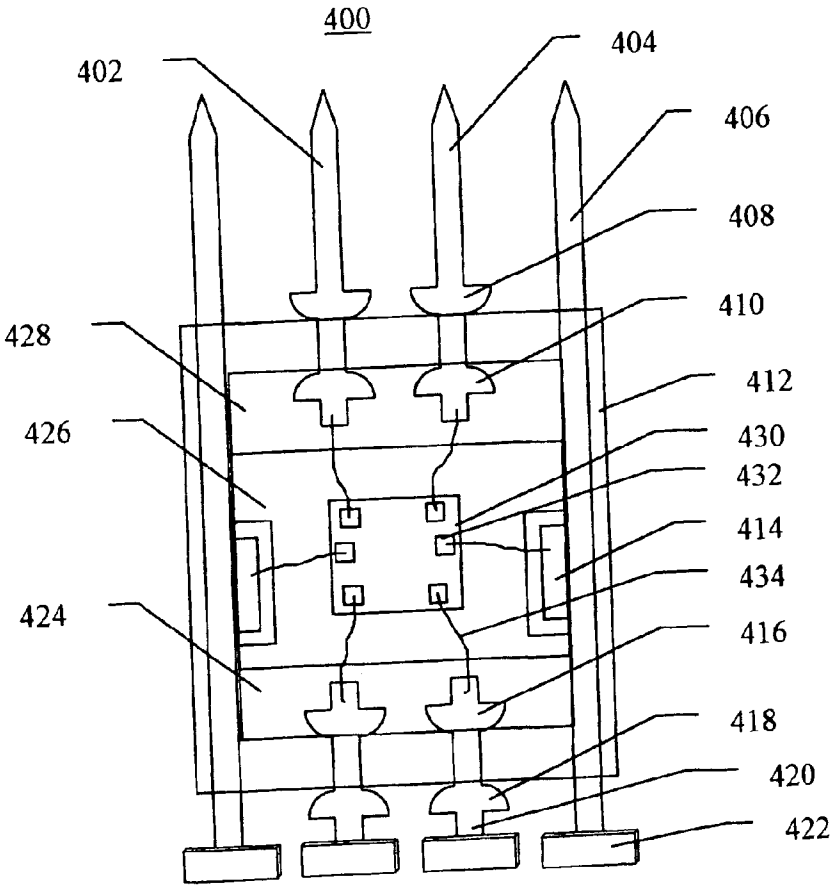
FIG. 7 illustrates an alternative embodiment of a substrate assembly for the integrated multi-chip electrical connector module of FIG. 3.
Figure 8:
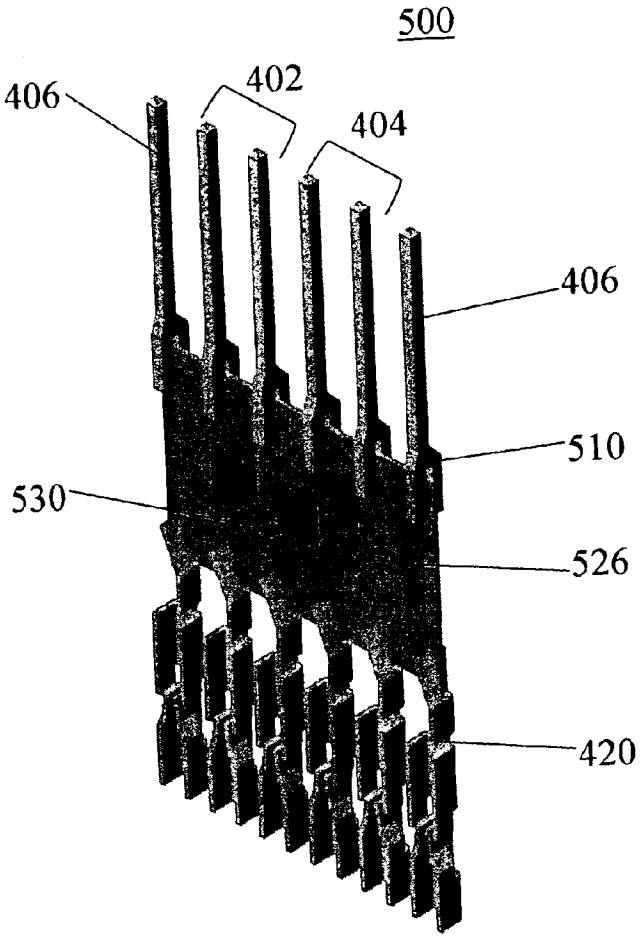
FIG. 8 illustrates yet another alternative embodiment of a substrate assembly for the integrated multi-chip electrical connector module of FIG. 3.

FIGS. 7 and 8 illustrate alternative embodiments of substrate carrier 320 of FIG. 3. As shown in FIG. 3, integrated multi-chip connector module 120 comprises an array of substrate carrier 320 encased in connector housing 340. Alternatively, multi-chip connector module 120 may comprise an array of substrate assemblies, such as substrate assembly 400 (FIG. 7) or substrate assembly 500 (FIG. 8). As shown in 7, substrate assembly 400 illustrates an alternative embodiment of substrate carrier 320. In this embodiment, each substrate assembly 400 comprises a substrate frame 412 to support connector pins such as 402, 404, 406, and 420. Substrate assembly 400 further comprises a substrate 426 securely attached to substrate frame 412 such as glued, screwed or integrated as part of substrate fame 412. Substrate 426 is provided for mounting one or more integrated circuit (ICs), 430 to substrate assembly 400. Metal pads 432 are provided on each semiconductor die 430 to electrically connect via wire bond 434 connector pins 402, 404, 406, and 420 on frame 412 to appropriate circuit locations on IC 430. Depending on the application and design needs, signal pins 402, 404, 406 and 420 may terminate in gold or metal pads, bumps, strips or other common connector termination contacts. Substrate assembly 400 also comprises cavities 424, 428 that will be filled with injected plastic during electrical connector assembly to lock an array of substrate assembly 400 in place to form the internal structure and array of semiconductor dice and connector pins in place.

Substrate frame 412 of substrate assembly 400 facilitates and ensures a reliable electrical coupling of connector pins to one or more mounted IC devices 430. Substrate frame 412 may comprise plastic or other structurally supportive, preferably lightweight and thermally conductive material. In the preferred embodiment, pin anchoring means 408, 410, 416, and 418 are provided to securely lock connector pins, particularly connector pins 402, 404, and 420 that are signal pins, to the substrate frame 412. Pin anchoring structures 408 and 410, 416, and 418 provide added security and reliable electrical conductivity from signal pins to the attached IC during installation and removal of the multi-chip electrical connector from an external connection, such as to a backplane, daughter card connector, or directly to a printed circuit board. Anchoring structure 408, 410, 416, and 418 may comprise same as the substrate frame 412, or different material with simlilar properties. Non-signal pins 406, comprising such as voltage (or power) or ground preferably also comprise metal contact pads 414 to facilitate electrical connection of semiconductor die 430 to power or ground pins 406.

Figure 9:
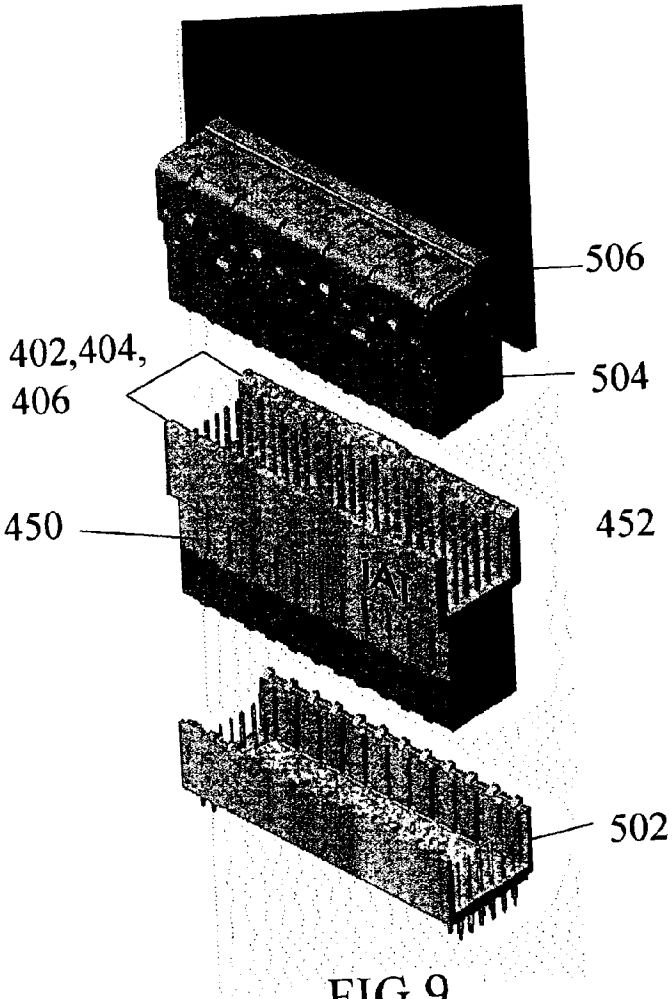
FIG. 9 illustrates one embodiment of a connector housing enclosing the integrated multi-chip module, preferably for electrically coupling to external connectors or directly to printed circuit boards.

In this example, pins 402, 404, and 406 might be connector pins receiving incoming electrical signals from a first external connection 504 (see FIG. 9), i.e., such as a daughter card connector, while connector pins such as signal pins 420 of FIG. 7 provide output signals from ICs 430 to a second external device, such as a backplane connection means 502 (see FIG. 9).

FIG. 8 illustrates yet another alternative embodiment of a substrate assembly stacked to form an array of substrate carriers for integrated multi-chip connector module 120 of FIG. 3. Each substrate assembly 500 comprises a substrate 526 that serves both as a substrate frame for attaching to connector pins 402, 404, 406, and 420, as well as a substrate for mounting one or more semiconductor dice 530. In this example, connector pins 402, 404, 406, and 420 all terminate at a first end in a carrier grip 510 to grip or attach to substrate carrier 526.

Variation to embodiments described are contemplated as within the scope of this invention. For example, it is contemplated that semiconductor devices besides one or more active integrated circuits may also be attached to the substrate carrier described above depending on design needs. Connector pin termination may comprise pads, bumps, or other such signal pin termination means.

FIG. 9 illustrates an alternative embodiment of a connector housing 450 encasing an array of substrate carriers such as 320, 400, or 500 of FIGS. 3, 7, and 8, respectively. A corresponding array of signal pin apertures in connector housing 450 allow signal pins on the substrate carriers to penetrate through the housing and be accessed externally for electrical connection to external devices.

Similar to multi-chip connector module 452 of FIG. 9, integrated multi-chip interface connector module 520, also referred to as an interposer 520, similarly comprise an array of substrate assemblies as described above relative to FIGS. 3, 7, and 8. A connector housing 460 such as having the form factor shown in FIG. 9, allows interposer 520 to be coupled to an existing backplane connector (not shown) and a daughter card connector. Female pins 466 would join male pins in a backplane connector (not shown). Male pins 464 would engage female pins on a mating line card (not shown). Once connector 520 is installed, interface connector 520 is locked in place by an affirmative latch mechanism 456 on connector housing 460. An array of substrate 468 (such as 320, 400, or 500, of FIG. 3, 7, and 8, respectively, are encased in a connector housing 460. Embedded circuit designed on IC 462 would drive the shortened transmission line in the backplane and implement configuration to change protocol, adjust frequency of the transmission, add error correction algorithms or other possible functions to the existing transmission path.

The above embodiments are only illustrative of the principles of this invention and are not intended to limit the invention to the particular embodiments described. Accordingly, various modifications, adaptations, and combinations of various features of the described embodiments can be practiced without departing from the scope of the invention as set forth in the appended claims.

What is claimed is:

1. An integrated multi-chip connector module comprising:

an array of substrate assemblies, wherein each substrate assembly comprises:

a substrate;

one or more semiconductor dice attached to the substrate;

a set of input connector pins, each input connector pin further comprising a first end and a second end, wherein the first end is provided to receive an incoming signal, and the second end is electrically connected to the one or more semiconductor dice on the substrate; and a set of output connector pins, each output connector pin further comprising a first and a second end, wherein the first end is electrically connected to the one or more semiconductor dice, and the second end is provided for transmitting a processed signal from the one or more semiconductor dice as an output signal to the second end of each output connector pin; and a connector housing for encasing the array of substrate assemblies, wherein the housing comprises a first set of signal pin apertures through which extend the set of input connector pins to allow external electrical connection to a first external device, and wherein the housing further comprises a second set of signal pin apertures through which extend the set of output connector pins to allow external electrical connection to a second external device, wherein the connector housing further comprises injection-molding a thermally conductive composite around the array of substrate assemblies to fill a plurality of cavities between the array of substrate assemblies, the injection-molded connector housing thereby forming a semiconductor packaging for the one or more semiconductor dice while securing in place the array of substrate assemblies, the one or more semiconductor dice, and the plurality of input and output connector pins.

2. The integrated multi-chip connector module of claim 1 wherein each substrate assembly further comprises a set of pin anchoring means, the set of pin anchoring means anchors the input or output connector pins to the substrate assembly.

3. The integrated multi-chip connector module of claim 1 wherein the second end of each input or output connector pin terminates in an electrically conductive pad.

4. The integrated multi-chip connector module of claim 1 wherein the second end of each input or output connector pin terminates in an electrically conductive cusp.

5. The integrated multi-chip connector module of claim 1 wherein the one or more integrated circuits process a set of input signals in a first pinout orientation and redistribute a corresponding set of output signals in a second pinout orientation.

6. The integrated multi-chip connector module of claim 1 wherein the one or more semiconductor dice receive a first set of data signals at a first electrical voltage level and generate in response a set of output signals comprising the first set of data signals at a second electrical voltage level.

7. The integrated multi-chip connector module of claim 1 wherein the set of output connector pins are provided to electrically couple to a backplane.

8. The integrated multi-chip connector module of claim 1 wherein the set of input connector pins are electrically coupled to an external line card.

9. An integrated multi-chip connector module assembly method comprising:

assembling one or more semiconductor dice on a substrate frame;

attaching a plurality of connector pins to each substrate frame and electrically connecting each connector pin to the one or more semiconductor dice on each substrate frame to transmit processed signals from the one or more semiconductor dice;

stacking into an array a plurality of the substrate frames to form an array of substrate frames; and encasing the stacked array of substrate frames in a connector housing, wherein the step of encasing the stacked array comprises injection molding a thermally conductive composite around the stacked array to eliminate a plurality of cavities between the array of substrates to form a semiconductor packaging around the one or more semiconductor dice and securing in place the stacked array, the one or more semiconductor dice, and the plurality of input and output connector pins.

10. The integrated multi-chip connector module assembly method of claim 9 wherein the step of electrically connecting each connector pin to the one or more integrated circuits on each substrate frames comprises wirebonding.

11. The integrated multi-chip connector module assembly method of claim 9 wherein the step of attaching each connector pin to the one or more integrated circuits on each substrate frames comprises a pin anchoring structure to secure the connector pin to the substrate assembly.

* * * * *